United States Patent [19]

Krubsack et al.

[11] 4,425,610

[45] Jan. 10, 1984

[54] ADJUSTABLE HEIGHT LIGHTING FIXTURE WITH SWIVEL MOUNTED LAMP ASSEMBLY

[75] Inventors: Larry J. Krubsack, Colgate; Thomas G. Volk, Germantown, both of Wis.

[73] Assignee: Hartland Products Company, Inc., Hartland, Wis.

[21] Appl. No.: 384,407

[22] Filed: Jun. 2, 1982

[51] Int. Cl.[3] ..... F21M 3/18

[52] U.S. Cl. ..... 362/419; 362/127; 362/250; 362/269; 362/270; 362/285; 362/427; 362/430; 362/431; 362/432; 248/416

[58] Field of Search ..... 362/419, 427, 430, 431, 362/432, 127, 269, 270, 285, 250; 248/416

[56] References Cited

U.S. PATENT DOCUMENTS

| | | | |
|---|---|---|---|
| 2,686,067 | 8/1954 | Stephans | 362/427 X |
| 2,950,892 | 8/1960 | Rick | 362/432 X |
| 3,200,554 | 8/1965 | Goodman et al. | 362/431 X |
| 3,341,163 | 9/1967 | Honig | 362/432 X |

*Primary Examiner*—Stephen J. Lechert, Jr.

*Attorney, Agent, or Firm*—Merriam, Marshall & Bicknell

[57] ABSTRACT

A lighting fixture that is adapted to be mounted on a normally concealed, vertical surface of a large musical instrument or item of furniture such that the lamp assembly and its supporting frame may be concealed when lowered to an inoperative position behind the musical instrument or furniture item. The fixture includes a bracket mounted on the concealed side of the musical instrument or furniture item, and the longer leg of an inverted, J-shaped frame is mounted in the bracket for vertically shiftable and pivotal movement. The longer leg has a plurality of vertically spaced grooves in the outer surface thereof, which coact with a ball detent in the bracket to releasably retain the frame and lamp assembly in different, vertical positions. A swivel mounting connects the lamp assembly to the shorter leg of the frame and limits the extent of rotation of the lamp assembly relative to the shorter leg of the frame. The swivel mounting includes a resilient member which takes up any clearance in the mounting and which serves to return the lamp assembly to a substantially horizontal position if accidentally displaced therefrom.

21 Claims, 8 Drawing Figures

FIG-1
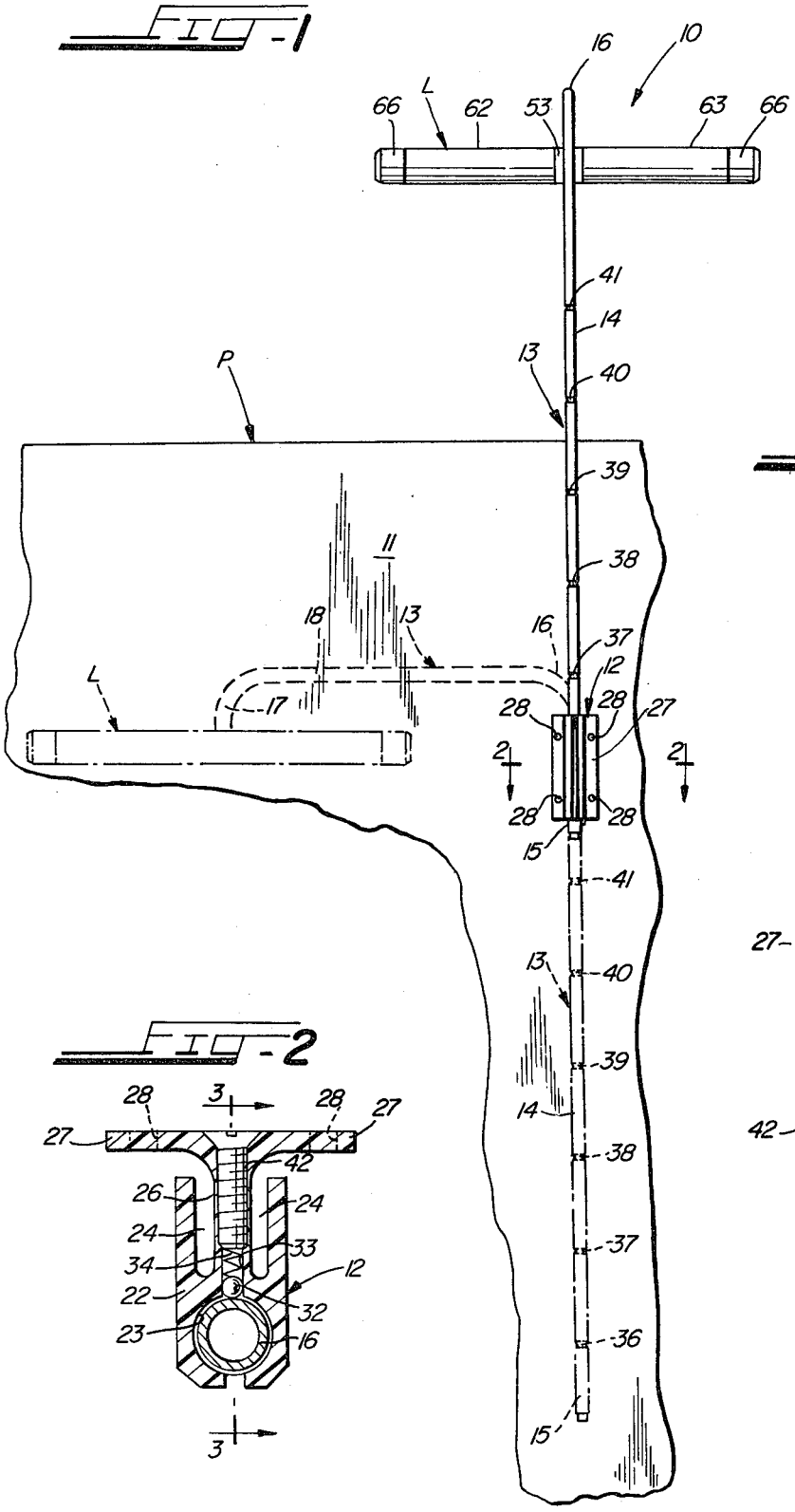
FIG-2
FIG-3
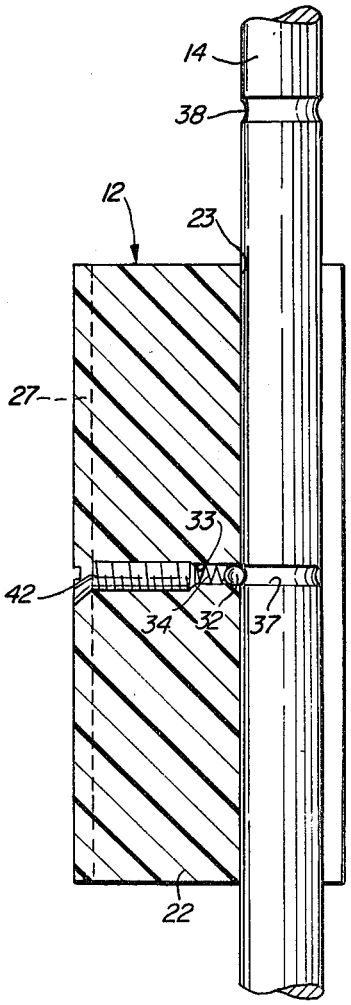

ADJUSTABLE HEIGHT LIGHTING FIXTURE WITH SWIVEL MOUNTED LAMP ASSEMBLY

This invention relates to lighting fixtures, and more particularly relates to a lighting fixture wherein the height of the lamp assembly of the fixture is adjustable and wherein a swivel mounting is employed between the lamp assembly and its supporting frame, which limits the extent of rotation of the lamp assembly relative to the frame, which prevents looseness in the assembled fixture, and which maintains the lamp assembly in a predetermined spatial relationship with respect to its supporting frame.

BACKGROUND OF THE INVENTION

Lighting fixtures have been heretofore developed for general and special purposes, and to achieve different objectives. Some of such fixtures were capable of being raised or lowered with respect to a surface or object to be illuminated, or swung from side to side. Examples of fixtures of this type are disclosed in the Doane U.S. Pat. No. 2,289,105, Senter U.S. Pat. No. 1,622,057 and McFaddin U.S. Pat. No. 1,429,443 patents. The lamp assembly of the lighting fixture disclosed in the Doane U.S. Pat. No. 2,289,105 was also capable of limited rotational movement with respect to the arm or tube on which the assembly was mounted.

While the adjustments incorporated into the lighting fixtures disclosed in the aforementioned patents increased their usefulness and versatility, the structures employed to effect such adjustments, and the manner in which such structures were actuated, were complex and frequently unreliable in operation.

Accordingly, it is a general object of the present invention to provide a novel and improved lighting fixture that is particularly adapted to be mounted on large musical instruments or pieces of furniture, or on a vertical wall adjacent thereto, such that the fixture may be rapidly and easily shifted between a selected one of a plurality of elevated operating positions, and a depressed, concealed, inoperative position hidden by the musical instrument or piece of furniture.

Another object is to provide a lighting fixture of the foregoing character, wherein a novel swivel connection is employed between the lamp assembly thereof and one end of the frame which supports the lamp assembly so that rotational movement of the lamp assembly relative to the supporting frame is limited.

A further object is to provide a novel lighting fixture of the foregoing character, wherein the swivel connection includes resilient structure for taking up any clearances in the connection and for returning the lamp assembly to a predetermined spatial relationship with respect to the supporting frame in the event of accidental displacement of the lamp assembly relative to the frame.

These and other objects will become apparent from the detailed description which follows, and accompanying sheets of drawings.

SUMMARY OF THE INVENTION

Briefly described, the present invention contemplates a novel vertically adjustable and rotatable lighting fixture which includes a mounting member having a plate portion that is adapted to be mounted on a vertical surface, in a concealed location, such as on the rear side of a large musical instrument or item of furniture capable of concealing the fixture. The mounting member has a vertically extending bearing bore therethrough for receiving and supporting a support member in an upright position. The support member includes an elongated, vertically extending pivot portion or leg that is axially shiftably and rotatably mounted in the bearing bore of the mounting member. The support member also includes another, vertically extending portion or shorter leg, which is connected at its upper end to the upper end of the pivot portion by a horizontally extending section. An elongated, generally cylindrical, lamp assembly is carried at the lower end of the shorter leg of the frame with the axis of the lamp assembly extending horizontally.

The frame and lamp assembly are shiftable between a depressed, concealed position behind the musical instrument or item of furniture, and a plurality of elevated, operative positions wherein the lamp assembly is positioned at different heights with respect to the associated musical instrument or item of furniture to be illuminated. The frame and lamp assembly are releasably retained in their elevated operative positions by detent means in the support bracket, which extends into a respective one of a plurality of axially spaced recesses in the longer leg of the frame. A spring biases the detent means into engagement with the recesses.

The lamp assembly is connected to the shorter leg of the frame by swivel means which includes a pivot member having a stem that extends through an opening in the housing of the lamp assembly and into the open lower end of the shorter leg of the support frame. A circumferentially extending slot is provided in the stem and a key member extends through an opening in the shorter leg of the frame and into the stem. The circumferential length of the slot is such that the extent of rotation of the lamp assembly relative to the frame is limited to less than 360°.

The swivel means also includes a resilient member, which serves to take up any clearance between the lamp assembly and shorter leg of the support frame and to provide an aligning force on these parts tending to maintain the axis of the lamp assembly in a predetermined spatial relationship with respect to the frame after assembly or when displaced from such position while the fixture is in use.

BRIEF DESCRIPTION OF THE DRAWINGS

FIG. 1 is a rear elevational view showing, in full lines, the vertically adjustable and rotatable lighting fixture of the present invention as it would appear when mounted on the rear of a piano or the like with the lamp assembly and its supporting frame in a fully elevated, operating position and also showing, in phantom line, the positions of the parts of the fixture when the lamp assembly and frame are in a depressed, concealed position;

FIG. 2 is an enlarged, cross sectional view taken along the line 2—2 of FIG. 1;

FIG. 3 is a vertical sectional view, with some parts in elevation, taken substantially along line 2—2 of FIG. 1;

DETAILED DESCRIPTION

Figure 4:
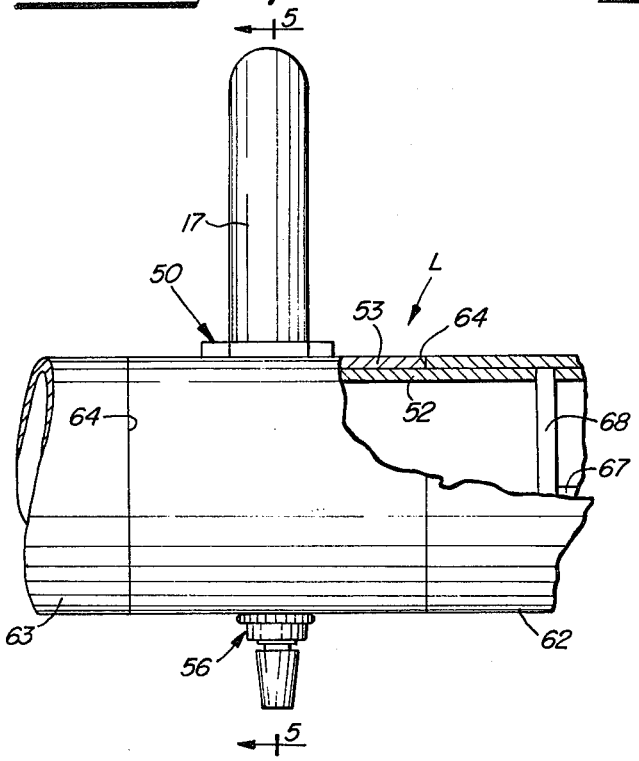
FIG. 4 is a fragmentary front elevational view with portions broken away to show underlying details, of the central portion of a lamp assembly and the shorter leg of the supporting frame of the fixture illustrated in FIG. 1.

In FIG. 1, a vertically adjustable and rotatable lighting fixture, embodying the features of the present invention is illustrated and indicated generally at 10. The fixture 10, in the present instance, is shown mounted on a vertical surface, in the present instance, the rear side, indicated at 11, of a spinet-type piano P that is diagrammatically illustrated in FIG. 1. It will be understood, however, that the fixture 10 could also be mounted on a substantially vertical surface of other large musical instruments, such as a grand piano or organ, or a substantially vertical surface of other large items of furniture, such as a couch or chair. The fixture 10 may also be mounted on a vertical wall adjacent to a large musical instrument or item of furniture, to thus permit the fixture to be shifted to a concealed position behind the instrument or item of furniture.

The fixture 10 thus comprises a mounting member or bracket 12, shown mounted on the rear side 11 of the spinet-type piano P, a support member or frame, indicated generally at 13 and carried by the bracket 12, and a lamp assembly, indicated generally at L and carried by the frame 13. The frame 13 includes an elongated, vertically extending first leg or pivot portion 14 having a lower end portion 15 and an upper end portion 16. The upper end portion 16 includes another vertically extending portion or shorter leg 17, and a horizontally extending section 18, which connects the upper ends of the vertically extending frame portions 16 and 17. Thus, the frame 13 is generally of a inverted J-shape.

As best seen in FIGS. 2 and 3, the bracket 12 includes an elongated, generally rectangular body portion having a vertically extending bore 23 therethrough comprising bearing means for supporting the vertically extending first leg or pivot portion 14 of frame 13. In order to reduce weight, the body portion 22 may be provided with a pair of vertically extending recesses or cavities 24 (FIG. 2) which define a central web section 26 in the body portion 22.

A pair of vertically extending flanges 27 extend laterally outwardly from the central web 26 and each is provided with one or more openings 28 (FIG. 1) therethrough to facilitate mounting of the bracket 12 on the vertical surface of a musical instrument, item of furniture, or wall adjacent thereto.

According to the present invention, the fixture 10 includes releasable retaining means carried by the bracket 12 and pivot leg 14 of the frame 13 for releasably retaining the frame and lamp assembly L in at least one and preferably a selected one of the plurality of vertically elevated, operative positions so that a desired lighting arrangement can be obtained on the associated musical instrument or item of furniture. Such releasable retaining means thus comprises detent means in the form of a ball 32 (FIG. 2) disposed in a transverse bore 33 in the central web 26 of the bracket 12, the ball 32 being biased into engagement with an aligned one of a plurality of axially spaced recesses or annular, circumferentially extending grooves in the pivot leg 14 of the frame 13 by spring means in the form of a coil spring 34. For example, six axially spaced grooves, indicated at 36–41, respectively, are provided in the outer surface of the pivot leg of the frame 13. A retaining member in the form of a screw 42 is threaded into the outer end of the transverse bore 33, the screw 42 serving to prevent the ball 32 and the spring 34 from falling out of the outer end of the bore 33 and to compress the spring 34.

From the foregoing description, it will be apparent that the height of the lamp assembly L of the fixture 10 can be readily adjusted to one of a plurality of six different elevated positions, merely by applying sufficient pressure to the frame 13 to cause the ball 32 to move out of the groove with which it is engaged, roll along the outer surface of the full diameter portion of the pivot portion 14 of the frame 13 until it seats in the next groove. Since grooves 36–41 extend circumferentially around the pivot portion 14, the frame 13, and the lamp assembly L, can be pivoted or swung about an axis through the pivot to a desired angular position with respect to the musical instrument or item of furniture on which the fixture 10 is mounted.

When not in use, the lamp assembly L and frame 13 may be shifted to a concealed position behind the item on which the fixture is mounted, as illustrated by the phantom line position of the lamp assembly L and frame 13 in FIG. 1. This is easily accomplished by swinging the lamp assembly L and horizontally extending section 18 of the frame toward the vertical surface on which the bracket 12 is mounted e.g. the rear side 11 of the piano P, and then applying sufficient downward force on the frame 13 to unseat the ball 32 and thus permit the frame to shift downwardly in the bracket 12. The lamp assembly L is connected to the lower end of the shorter leg 17 of the frame 13 by a swivel means in the form of a swivel mounting embodying the features of the present invention and indicated generally at 50 in FIGS. 4 and 5. The swivel mounting 50 permits the lamp assembly L to rotate relative to the frame 13 and will be described more fully hereinafter.

Figure 5:
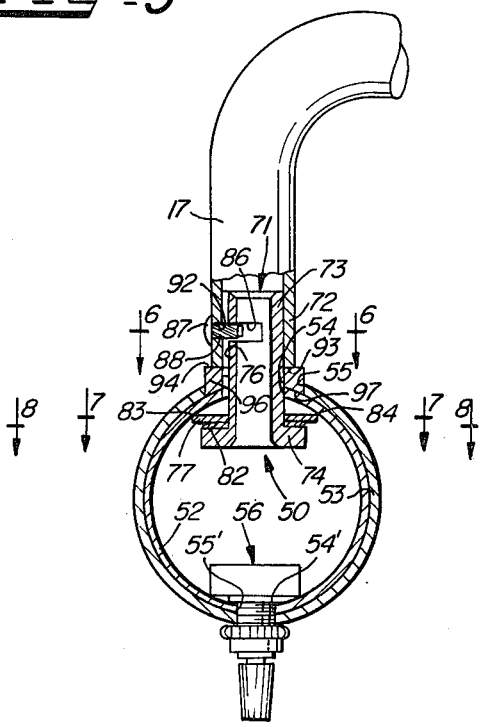
FIG. 5 is a vertical sectional view, with some parts in elevation, taken substantially along the line 5—5 of FIG. 4.

Referring now to FIGS. 4 and 5 in conjunction with FIG. 1, it will be seen that the lamp assembly L comprises a tubular, shade support member 52 (FIGS. 4 and 5), which is enclosed by a shorter sleeve 53, the shade support member 52 and sleeve 53 having diametrically spaced, vertically extending bores therethrough. The diametrically extending bores in the top and bottom of the support member 52 and sleeve 53 are indicated at 54,55 and 54',55', respectively, in FIG. 5. An electrical switch assembly, indicated at 56 in FIGS. 4 and 5, is mounted in the bores 54' and 55'.

The supporting member 52 serves to receive and support a pair of elongated, tubular shades 62 and 63 of the same inside and outside diameters as the sleeve 53 so that the shades form continuations of the sleeve when the inner ends, indicated at 64, of the shades are engaged with the sleeve 53, as illustrated in FIGS. 1 and 4. The outer ends of the shades 62 and 63 are closed by plugs 66 which are preferably of a material of low heat conductivity so as to facilitate manipulation of the shades 62 and 63 to different rotated positions on the support member 52 to direct light from a pair of incandescent bulbs (not shown) mounted in sockets (also not shown) carried by the shade support member 52. The shades have elongated openings therein (not shown) which permits the light from the bulbs to be directed in different directions. The shades 62 and 63 may be removed from the support member 52 by rotating the same until an inwardly extending pin (not shown) on the inner ends of the shades registers with axially extending grooves 67 in the outer end of the support member 52, one of the grooves 67 being illustrated in FIG. 4, and then shifting the shades axially outwardly until they are disengaged from the support member 52. The inner ends of the axial grooves 67 intersect circumferentially extending grooves in the outer ends of the support members 52 and serve to prevent unintentional disengagement of the shades from the mounting member 52.

As previously mentioned, the lamp assembly L includes the swivel means in the form of the swivel mounting 50 for connecting the lamp assembly L to the lower end, indicated at 72, of the shorter leg 17 of the frame 13 so that the lamp assembly L may be rotated relative to the leg 17. The swivel mounting 50 thus comprises a pivot member having a tubular stem 73 of substantially the same outside diameter as the internal diameter of the shorter leg 17 of the frame 13, and an enlarged, circular head 74. A flat 76 is provided on one side of the stem 73 so that the exterior or outer periphery thereof is noncircular.

In order to prevent rotation of the stem 73, relative to the lamp assembly L, a locking member in the form of a washer 77 having a non-circular opening 78 therein of substantially the same cross sections as that of stem 73, is mounted on the stem before the latter is extended upwardly through the opening 54 in the shade support member 52. The non-circular configuration of the opening 78 is provided by a straight portion 81, which is of substantially the same length and position as the flat 76 on the stem 73. The remainder of the opening 78 is circular and has a radius substantially equal to that of the outer periphery of the stem 73. Resilient means in the form of a wave washer 82 is interposed between the washer 77 and head 74 of the pivot member 71 prior to insertion of the stem 73 through the openings 54 and 55 in the tubular members 52 and 53. Thus, when the pivot member 71 is operably positioned in the tubular support member 52 and sleeve 53, the edges 83 and 84 of the washer 77, which are parallel to the flat portion 81 of the washer opening 78, engage the inner surface of the tubular support member 52 and prevent rotation of the washer 77 and, consequently, the pivot member 71, relative to the support member 52 and sleeve 53. In other words, the pivot member 71 is fixed with respect to the members 52 and 53 and also with respect to the shades 62 and 63 of the lamp assembly L.

Figure 6:
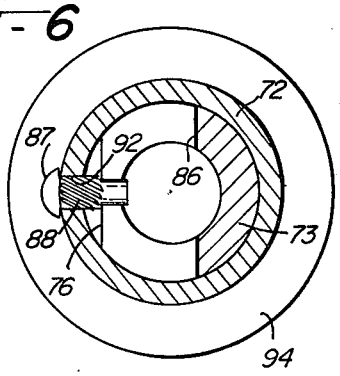
FIGS. 6, 7 and 8 are a series of enlarged, cross sectional views, with portions thereof in elevation, taken substantially along the lines 6—6, 7—7 and 8—8, of FIG. 5.
Figure 7:
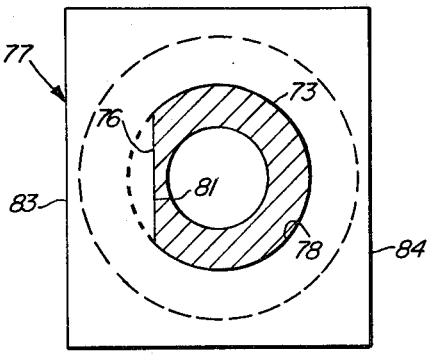
Figure 8:
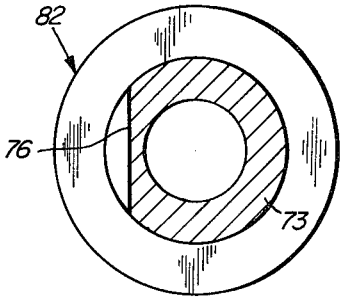

According to the present invention, the swivel mounting 50 includes means for limiting rotation of the lamp assembly L relative to the leg 17 of the frame 13. Such rotation limiting means serves to prevent the electrical conductors of the fixture 10 (not shown), which enter the lower end of the tubular frame 13 and which extend through the hollow interior of the stem 73 from being twisted off if the shades and mounting members 52 of the lamp assembly were freely rotatable. The rotation limiting means thus preferably comprises a circumferentially extending recess or slot 86 (FIGS. 5 and 6) in the stem 73 and a key member in the form of a pin or drive screw 87. The threaded shank, indicated at 88, of the drive screw 87 frictionally engages an opening 92 in the lower end of the leg 17, the opening 92 being axially located in the lower end of the leg so that the inner end of the drive screw 87 extends into the slot 86 when the stem 73 is fully inserted into the lower end 72 of the leg 17 and with the axial end face, indicated at 93, of the end 72 engaging the upper face, indicated at 94, of a washer 96. The outside diameter of the washer 96 is less than the diameter of the opening 55 and the lower face, indicated at 97, of the washer 96 is cylindrically concave. Consequently, the washer 96 seats on the upper surface of the mounting member 52 in non-rotatable relation when the parts of the swivel mounting 50 are fully engaged.

With the foregoing construction, it will now be apparent that the slot 86 in the stem 73 coacts with the shank 88 of the drive screw 87 to limit rotation of the lamp assembly L in either direction with respect to the axis of the stem 73. In this regard, the length of the slot 86 is such that the stem 73, and hence the shades 62 and 63 of the lamp assembly L, may rotate through an angle of approximately 90° in a clockwise or counterclockwise direction from the position wherein the axis of the shades 62 and 63 is perpendicular to the plane of the frame 13 as indicated in FIG. 1. Thus, the total range of angular movement of the shades 62 and 63 with respect to the frame 13 is less than 360° and about 180°.

As heretofore mentioned, the swivel mounting 50 includes the resilient means or wave washer 82 interposed between the head 74 of the pivot member 71 and the underside of the locking washer 77. The wave washer 82 provides resiliency in the swivel connection of the lamp assembly L and the lower end 72 of the shorter leg 17 of the frame 13 and also provides a biasing force tending to return the axis of the coaxial shades 62 and 63 to a perpendicular spatial relationship with that of the axis of the shorter leg 17 in the event that the shades of the assembly are displaced from the aforementioned perpendicular position when the fixture 10 is in use.

From the foregoing description, it will now be appreciated that the lamp assembly L of the fixture 10 is capable of being rapidly and easily adjusted to different operating heights with respect to a large musical instrument, such as the spinet piano P, or an item of furniture on which the fixture is mounted, merely by applying sufficient force to the frame 13 of the fixture to displace the detent ball 32 in the bracket 12 from one of the circumferential grooves 36–41 in the leg 16. Beacuse of the ball and groove construction utilized in the bracket 12 and frame 13, the frame 13 and lamp assembly L may be easily rotated to different angular positions with respect to the item on which the fixture is mounted without disturbing the adjusted height position of the lamp assembly L.

It will also be understood that the swivel mounting 50 employed in the fixture 10 permits the coaxial shades 62 and 63 of the fixture, as well as the bulbs enclosed by the shades, to be rotated about a horizontal axis throughout a range of angular positions in order to provide a desired lighting for a user of the fixture. The slot 86 and the drive 87 utilized in the swivel mounting 50 limits the extent of rotation of the lamp assembly L, relative to the frame 13, thereby preventing the electrical conductors in the tubular frame 13 and stem 73 from being shorted together or twisted off. The resiliency of the wave washer 82 likewise serves to take up clearance in the swivel mounting 50 and to maintain the shades 62 and 63 of the lamp assembly L in a substantially, perpendicular spatial relationship with that of the leg 17 of the frame 13 while the fixture is in use. The washer 82 also prevents damage to the fixture as a result of accidental force being applied to one or the other of the shades 62 or 63 thereof.

It will further be understood that, while the ball detent 32 and spaced annular grooves 36–41, as well as the swivel mounting 50, have been herein described in connection with the frame 13, these features could also be utilized in a support structure for the lamp assembly L having a configuration other than that of the frame 13.

For example, the aforementioned ball detent and groove construction, as well as the swivel mounting 50, could be employed in a frame having a curved section between the vertically extending portions thereof, or could be employed in a frame having a straight, vertically extending portion or post. In the latter modification, the swivel mounting would be mounted in an inverted position in the open upper end of the frame.

While one or more embodiments of the invention have been herein illustrated and described, it will be understood that modifications and variations thereof may be developed which do not depart from the spirit of the invention and the scope of the appended claims.

I claim:

1. A lighting fixture having a vertically adjustable and swivel mounted lamp assembly and adapted to be mounted on a vertical surface of or adjacent to a musical instrument or article of furniture or the like, said fixture comprising a mounting member adapted to be mounted on said vertical surface, said mounting member having vertically extending bearing means therein, a support member including an elongated vertically extending pivot portion mounted in said bearing means for axially shifted and rotatable movement, said pivot portion having a plurality of axially spaced recesses therein, detent means mounted in said mounting member and movable into an aligned one of said recesses for releasably retaining said support member in one of a plurality of vertically adjusted positions, said support member being rotatable about a vertical axis through said pivot portion while said detent means is engaged with one of said recesses, said support also including another vertically extending portion spaced from said pivot portion, swivel means carried by said other vertically extending portion of said support member, and a lamp assembly connected to said swivel means for rotation about a vertical axis through said other vertically extending portion, said swivel means including means for limiting rotation of said lamp assembly relative to said other vertically extending portion to a predetermined angular range.

2. The lighting fixture of claim 1, in which said support member comprises a frame having said spaced vertically extending portions and a horizontally extending section connecting said vertically extending portions.

3. The lighting fixture of claim 2, in which said frame is generally in the shape of an inverted letter J.

4. In a vertically adjustable lighting fixture including a mounting member adapted to be mounted on a vertical surface of or adjacent to a musical instrument, article of furniture, or the like, said mounting member having a vertically extending bearing bore therethrough, a support member having an elongated vertically extending portion having upper and lower ends, said vertically extending portion being mounted in said bearing bore for vertically shiftable and rotatable movement relative to said mounting member, and a lamp assembly carried by the upper end of said vertically extending portion, the improvement of releasable retaining means carried by said mounting member and said vertically extending portion for releasably retaining said support member in at least one vertically elevated, operative position, said releasable retaining means comprising at least one recess in said vertically extending portion and detent means mounted in said mounting member and movable into said recess, and spring means biasing said detent means toward said vertically extending portion and into said recess, said detent means and said recess being constructed and arranged to permit said detent means to move out of said recess, regardless of the rotated position of said vertically extending portion, whereby said support member can be raised to an elevated operative position in order to position said lamp assembly at a desired vertical height with respect to an associated musical instrument or article of furniture or the like, or shifted to a depressed position in which said lamp assembly is concealed by said associated musical instrument or article of furniture by applying sufficient force to said support member to overcome the biasing force of said spring means and movement of said detent means out of said recess.

5. The lighting fixture of claim 4, in which a plurality of vertically spaced recesses are provided in said vertically extending portion.

6. The lighting fixture of claim 4, in which said recesses comprise circumferentially extending, annular grooves in the outer surface of said elongated, vertically extending portion, whereby said support member and said lamp assembly may be shifted between different ones of a plurality of vertically elevated, operative positions.

7. The lighting fixture of claim 4, in which said mounting member has a bore therein extending transversely to and intersecting said bearing bore, and said detent means and said spring means are mounted in said transverse bore.

8. The lighting fixture of claim 7, in which said detent means comprises a ball.

9. The lighting fixture of claim 8, in which said spring means comprises a coil spring, the inner end of said coil spring engages said ball, and a retaining member is mounted in the outer end of said transverse bore for engaging the outer end of and compressing said coil spring.

10. The lighting fixture of claim 9, in which said retaining member comprises a screw threaded into the outer end of said transverse bore.

11. In a lighting fixture including a mounting member adapted to be mounted on a vertical surface of or adjacent to a musical instrument, article of furniture or the like, a support member having a vertically extending portion carried by said mounting member, said vertically extending portion having upper and lower end portions, and said upper end portion being adapted to receive and support a lamp assembly, the improvement comprising swivel means carried by said upper end portion of said vertically extending portion and said lamp assembly and permitting relative rotation between said upper end portion and said lamp assembly, said swivel means including a pivot member fixedly engaged with said lamp assembly so as to be rotatable therewith, said pivot member having a stem extending into said upper end portion in telescoping relation, and means for limiting said relative rotation between said upper end portion of said vertically extending portion and said lamp assembly, said limiting means including a circumferentially extending slot in one of said upper end portion and said stem and a key member carried by the other of said upper end portion and said stem and disposed in said slot.

12. The lighting fixture of claim 11, in which the length of said slot is such that the extent of rotation of said lamp assembly relative to the upper end portion of said vertically extending portion is less than 360° and about 180°.

13. The lighting fixture of claim 11, in which the upper end portion of said vertically extending portion is tubular and has an open end, said circumferentially extending slot is spaced from said open end, said stem extends into said tubular end portion, and said key member comprises an elongated fastener threaded into said upper end portion and extending into said slot.

14. The lighting fixture of claim 12, in which said elongated fastener comprises a drive screw driven into an opening in the upper end portion of said vertically extending portion.

15. The lighting fixture of claim 12, in which said lamp assembly includes a housing having an opening therein, said stem has an enlarged head at one end thereof that is larger than said opening in said housing, said stem extends through the opening in lamp assembly housing, and locking means is carried by said stem for engaging said lamp assembly housing and preventing relative rotation between said stem and said lamp assembly housing.

16. The lighting fixture of claim 15, in which said locking means comprises a non-circular portion on the exterior of said stem and a locking washer mounted on said stem and having a non-circular opening therein mating with the exterior said stem.

17. The lighting fixture of claim 14, in which the non-circular portion on the exterior of said stem comprises a flat.

18. The lighting fixture of claim 14, in which the outer periphery of said locking washer is non-circular.

19. The lighting fixtures of claim 15, in which resilient means is carried by said pivot member to take up clearance between said pivot member and the housing of said lamp assembly and to maintain said lamp in a predetermined spatial relationship with respect to said upper end portion of said vertically extending portion.

20. The lighting fixture of claim 19, in which said resilient means comprises a wave washer positioned between said locking washer and said enlarged head.

21. The lighting fixture of claim 11, in which the upper end portion of said vertically extending portion includes another vertically extending portion spaced from said first mentioned vertically extending portion, a horizontally extending section connects the upper ends of said vertically extending portions, and said swivel means is carried at the lower end of said other vertically extending portion.

* * * * *